United States Patent [19]

Floeter

[11] Patent Number: 4,794,820

[45] Date of Patent: Jan. 3, 1989

[54] MARINE DRIVE TWIN LEVER REMOTE CONTROL WITH INTERLOCK OVERRIDE

[75] Inventor: Larry A. Floeter, Campbellsport, Wis.

[73] Assignee: Brunswick Corporation, Skokie, Ill.

[21] Appl. No.: 35,482

[22] Filed: Apr. 7, 1987

[51] Int. Cl.[4] ..... G05G 5/08; F16H 57/06

[52] U.S. Cl. ..... 74/878; 74/500.5

[58] Field of Search ..... 74/878, 483 R, 477, 74/501 R, 501 A, 523, 475, 473 R, 483 K; 192/3.63, 0.092

[56] References Cited

U.S. PATENT DOCUMENTS

| | | | |
|---|---|---|---|
| 1,974,096 | 9/1934 | Bartz | 74/878 |
| 2,351,485 | 6/1944 | Conkle | 74/878 X |
| 2,493,592 | 1/1950 | Peabody | 74/878 |
| 2,716,474 | 8/1955 | Panish | 74/483 X |
| 3,382,737 | 5/1968 | Manzolillo | 74/878 |
| 3,894,443 | 7/1975 | Beig et al. | 74/878 X |
| 4,160,499 | 7/1979 | Baba | 74/878 X |
| 4,367,659 | 1/1983 | Karpathian et al. | 74/500.5 |
| 4,478,109 | 10/1984 | Kobelt | 74/878 |

FOREIGN PATENT DOCUMENTS

| | | | |
|---|---|---|---|
| 2402057 | 8/1975 | Fed. Rep. of Germany | 74/501 A |
| 1345519 | 10/1963 | France | 74/483 R |

OTHER PUBLICATIONS

"Kobelt Push-Pull Controls", Kobelt Manufacturing Company Ltd., Richmond, British Columbia, Canada.

Panish Controls, Type A-1204, Interlock Positrol, Series 1200, Series 1500, Series 1800, Series 2500, Series 2600, Series 2700, Series 2800, 191-203 Bennett Street, Bridgeport, CT 06605.

*Primary Examiner*—Gary L. Smith

*Assistant Examiner*—Rodney M. Lindsey

*Attorney, Agent, or Firm*—Andrus, Sceales, Starke & Sawall

[57] ABSTRACT

A twin lever control actuator (10) operates push-pull cables (17, 17*a*) and has two sets of pulleys (12, 12*a* and 13, 13*a*) on opposite sides of a control body (11). Interlock structure (120-124, 126, 128, 132, 134) normally prevents movement of the shift lever (14) and its cable (17) when the throttle lever (14*a*) and its cable (17*a*) are in a high speed position and with the operator applying normal force to the shift lever (14). Override structure (136, 148, 150, 152, 154) permits movement of the shift lever (14) and its cable (17) with the throttle lever (14*a*) in a high speed position when the operator applies an abnormally high force to the shift lever (14), to enable emergency high speed shifting including from forward to reverse, to facilitate rapid deceleration.

11 Claims, 2 Drawing Sheets

MARINE DRIVE TWIN LEVER REMOTE CONTROL WITH INTERLOCK OVERRIDE

BACKGROUND AND SUMMARY

The invention arose during development efforts relating to a marine drive two lever remote control, particularly to prevent shifting to forward or reverse at high engine speed, and also to permit emergency shifting when needed, even at high engine speed.

Marine drive twin lever remote controls are known. One lever is a shift lever and controls the transmission, clutch or other shift mechanism that allows changing the propeller rotation direction to provide forward, reverse or neutral boat motion. The other lever is a throttle lever and controls engine speed. In some installations, these two levers can be operated independently, which can result in damage to the boat drive transmission if the control is improperly operated. If the boat operator is inexperienced or inattentive, he may forget to reduce the engine speed by moving the throttle lever prior to shifting the transmission with the shift lever. Depending on the design of the transmission or shift mechanism, this shifting at higher than recommended engine speed can damage the transmission or cause extreme wear.

In the present invention, an interlock device is included in a dual lever remote control, and will prevent the boat operator from shifting the transmission at too high an engine speed. In the preferred embodiment, the interlock mechanism, attaches to the control at otherwise unused cable attachment points. Twin lever controls typically have two attachment points on each lever to allow attaching the control cable to one point or the other to obtain the desired cable direction (push or pull) to control various engine and transmission models. The interlock includes a pair of link rods attached to the otherwise unused attachment points. The rods pass through and are guided by a guide member mounted to the control body frame. The rod attached to the throttle lever has a notch in the side corresponding to proper engine speed for shifting without damage. The rod attached to the shift lever has three notches in the side along its length corresponding to forward, neutral and reverse shift positions. A spherical ended shuttle pin, or a pair of balls, located in the center of the guide between the rods controls the relative motion of the rods and thus the two control levers. The length of the shuttle pin is such that both rods cannot move freely at all times. One of the rods must be positioned so that the shuttle pin falls into one of its notches before the other rod can be moved freely. The shift rod cannot be moved from one shift position to another unless the notch in the throttle rod is lined up with the shuttle pin allowing the shuttle pin to move sideways and make room for the shift rod to move. This constrains shifting to low engine speed or idle range as defined by the length of the throttle rod notch Threaded rod ends facilitate adjustment as needed to set the maximum engine speed for shifting and to synchronize the notches in the link rods with the shift positions in the transmission.

The invention also includes an override. In some boating situations, particularly with inexperienced operators or in an emergency situation with experienced operators, the interlocking of the shift and throttle functions may be undesirable. The only method of rapidly reducing the boat's forward speed is to shift the transmission into reverse and increase engine speed to use reverse propeller thrust to slow the boat. With an interlock installed in a two lever remote control, the only way to accomplish this is to move the throttle lever to idle position, move the shift lever from forward through neutral into reverse, and then advance the throttle again as needed to slow the boat. This sequence of three operations may not be easily carried out by an inexperienced operator suddenly confronted with the need to quickly stop or slow the boat. The inexperienced operator's tendency may be to pull on only one lever. If the throttle lever was the only grabbed and pulled to idle, then at least the forward speed would be reduced, although not as rapidly as it would be if followed by shifting to reverse and then increasing engine speed again. If the shift lever was the one grabbed and pulled, and the control had an interlock installed, the shift lever would not move. The two lever remote control would be functioning as designed, i.e. the intention being to prevent damage to the transmission. However, the boat would continue to maintain speed without slowing.

Since a transmission will generally tolerate a few shifts at high engine speed without damage, or at least without ceasing to function, it is considered desirable to permit a high engine speed shift if it is necessary to prevent greater property damage or personal injury. To allow for this situation, the present invention includes an override in addition to the interlock. The interlock prevents the noted shifting upon application of normal force by the operator. However, upon application of abnormally high force, e.g. when applied by an operator in a panic or emergency boating situation, the override feature enables the desired shifting.

In the preferred embodiment, one of the guide passages for the link rods is transversely widened, and the link rod can move sideways if not for an external U-shaped spring holding it in position. If enough force is applied to the shift lever, the cams or ramps of the notches on the shift rod will force the throttle rod sideways by bending and flexing the spring outwardly. This will allow moving the shift rod even though the throttle rod is not in the low engine speed position that normally allows shifting. The U-shaped spring prevents overriding the interlock with normal operating force, but allows such overriding upon application of abnormal force, i.e. force as might be generated by an operator in an emergency or panic boating situation.

DETAILED DESCRIPTION

Figure 1:
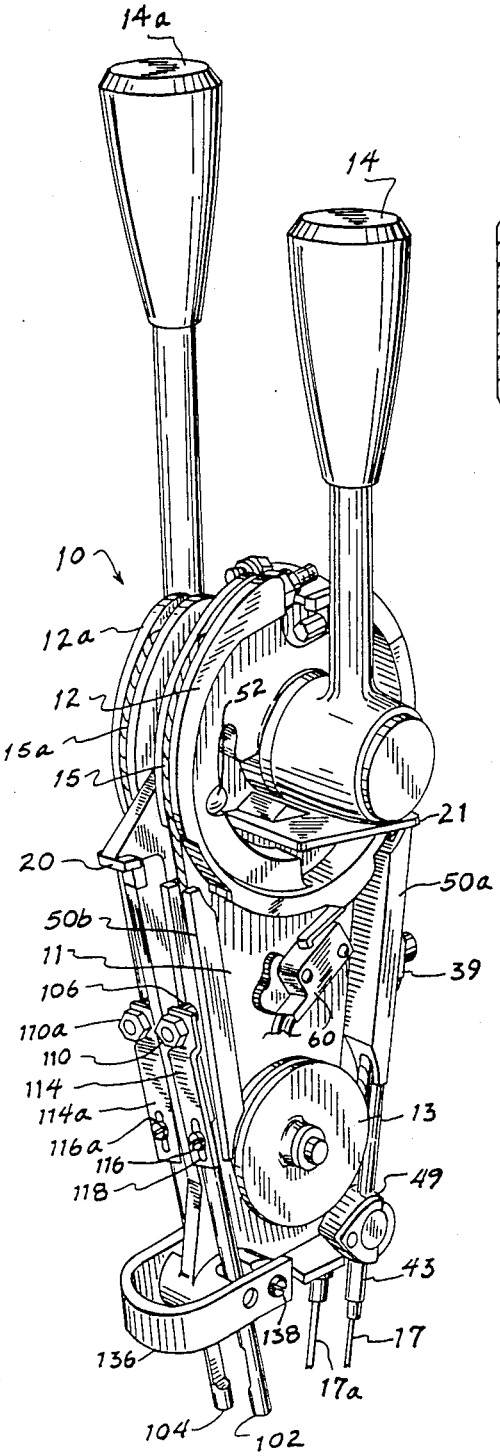
FIG. 1 is a perspective view of a marine drive twin lever remote control assembly in accordance with the FIG. 2 is an end elevation view partly in section of the assembly of FIG. 1.
Figure 2:
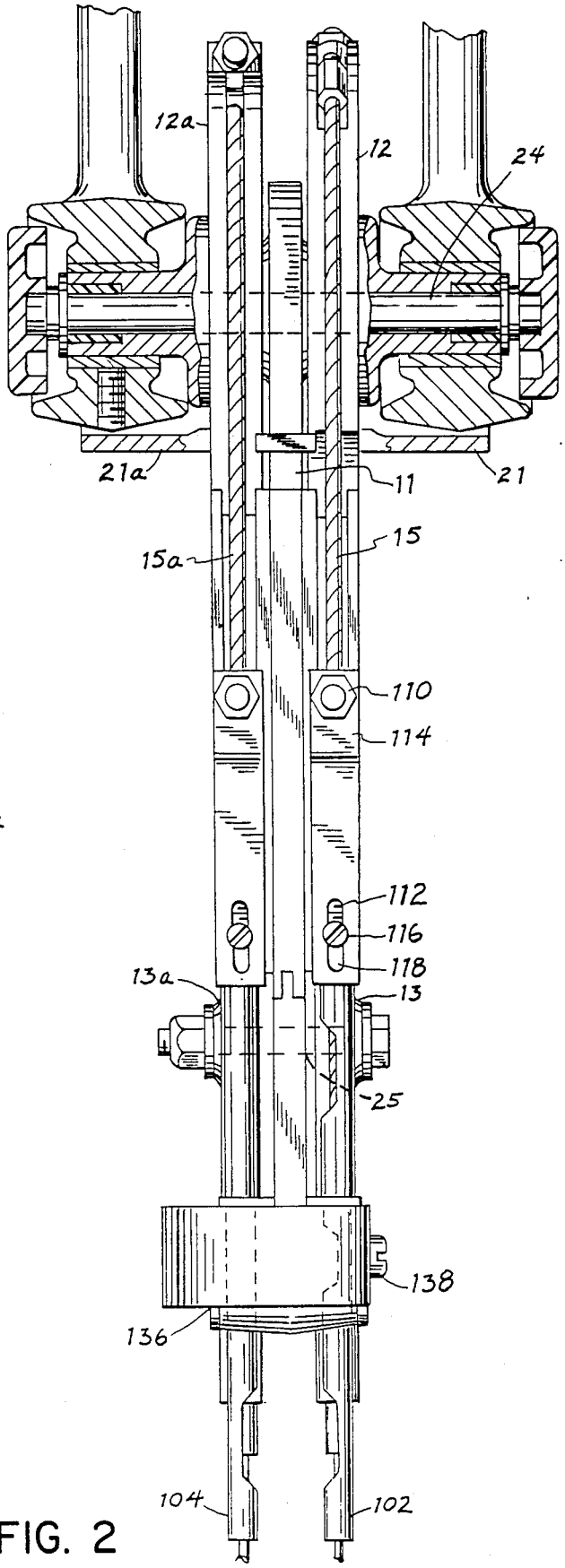

Illustrated in the drawings is a dual lever control assembly 10 for operating the throttle and the transmission or clutch of a remotely located marine propulsion device such as an outboard motor or a stern drive (not shown). The assembly includes various components and structure similar to that shown in Karpathian et al U.S. Pat. No. 4,367,659, incorporated herein by reference, which will be briefly described using like reference numerals where appropriate to facilitate clarity.

The assembly includes a control body 11 supporting two identical control arm pulleys 12 and 12*a* and two idler pulleys 13 and 13*a*. Control levers 14 and 14*a* are attached to the control arm pulleys 12 and 12*a*, respectively. Pulley cables 15 and 15*a* are mounted in circumferential grooves on each pulley of the pulley sets and are attached to respective control arm pulleys 12 and 12*a*. Push-pull cables 17 and 17*a* are mounted on each side of body 11 with their cores attached to the pulley cables 15 and 15*a*, respectively, and their sheaths attached to control body 11 to provide linear movement of the core element. Two steel shafts 24 and 25 are force fit through control body 11. Shaft 24 supports the two control arm pulleys 12 and 12*a* for rotation, and shaft 25 supports the two idler pulleys 13 and 13*a* for rotation, as in the above noted Karpathian et al patent. Control body 11 includes two end mounting lugs 20 and 20*a* and two side mounting plates 21 and 21*a* for supporting the assembly on any appropriate surface as in the above noted Karpathian et al patent.

The two pulley cables 15 and 15*a* carried by the pulleys 12, 12*a* and 13, 13*a* are attached to the control arm pulleys 12 and 12*a*, respectively. Each cable has a male threaded fitting 34 and a plug 35, swaged on opposite ends. The plugged end 35 is retained in notch 36 at the end of the pulley circumferential groove, the cable 15 is looped around idler pulley 13, and nut 37 is used to adjust the cable tension against the radial face 38 on control arm pulley 12, all as in the above noted Karpathian et al patent. Threaded stud block 39 is also swaged to pulley cable 15 between the pulleys to provide a means for attaching the core of push-pull cable 17 to pulley cable 15. A comparable stud block (not shown) is provided on the other side of control body 11 for attaching the core of push-pull cable 17*a* to pulley cable 15*a*, also as in the above noted Karpathian et al patent.

To limit the rotation of control are pulley 12, stops 40, 40*a* are provided on control body 11. The side mounting plate 21 projects through opening 41 in control arm pulley 12. Abutments or stop surfaces 40, 40*a* coact with stop surfaces 42, 42*a*, respectively, on control arm pulley 12 to limit the control arm pulley to 90° of rotation. The system of stops serves to limit the movement of the pulley cable stud block 39 to the straight run of pulley cable between the pulleys. Control arm pulley 12*a* on the other side of control body 11 is likewise provided with the comparable system of stops to limit the movement of the stud block attached to pulley cable 15*a* to the straight run of pulley cable between the pulleys 15*a* and 13*a*, all as in the above noted Karpathian et al patent.

Conventional flexible push-pull cables 17, 17*a* are connected to assembly 10. The end of cable 17 has a rigid tube 43 at the end of the cable sheath and a rigid bar 44 at the end of the cable core coaxial therewith. Hole 45 in the flattened end of bar 44 fits on threaded stud block 39 on pulley cable 15 and is attached with lock nut 46 to prevent any lost motion between the pulley cable 15 and the push-pull cable core. A coupling barrel 47 affixed to cable tube 43 fits into a bore 48 in control body 11 with the cable passing through the slot 49 while a retainer plate holds the coupling barrel 47 in place to attach the tube 43 to the control body 11, as in the above noted Karpathian et al patent. Cable 17*a* is comparably attached and guided on the other side of control body 11. The above noted Karpathian et al patent provides support means in the form of ridges 50 on control body 11 parallel to the straight run of pulley cable to stabilize the push-pull cable ends under heavy loads. In the present structure, these ridges are modified to box-shaped form to provide guide channels for example as shown at 50*a* and 50*b*. The present structure includes adjustable control loading of pulleys 12 and 12*a*, as in the above noted Karpathian et al patent, with ball detent structure 52. Also as in the above noted Karpathian et al patent, cam surfaces 59 on the outer rims of the control arm pulleys are provided to activate electrical switches, for example neutral safety switch 60.

Figure 3:
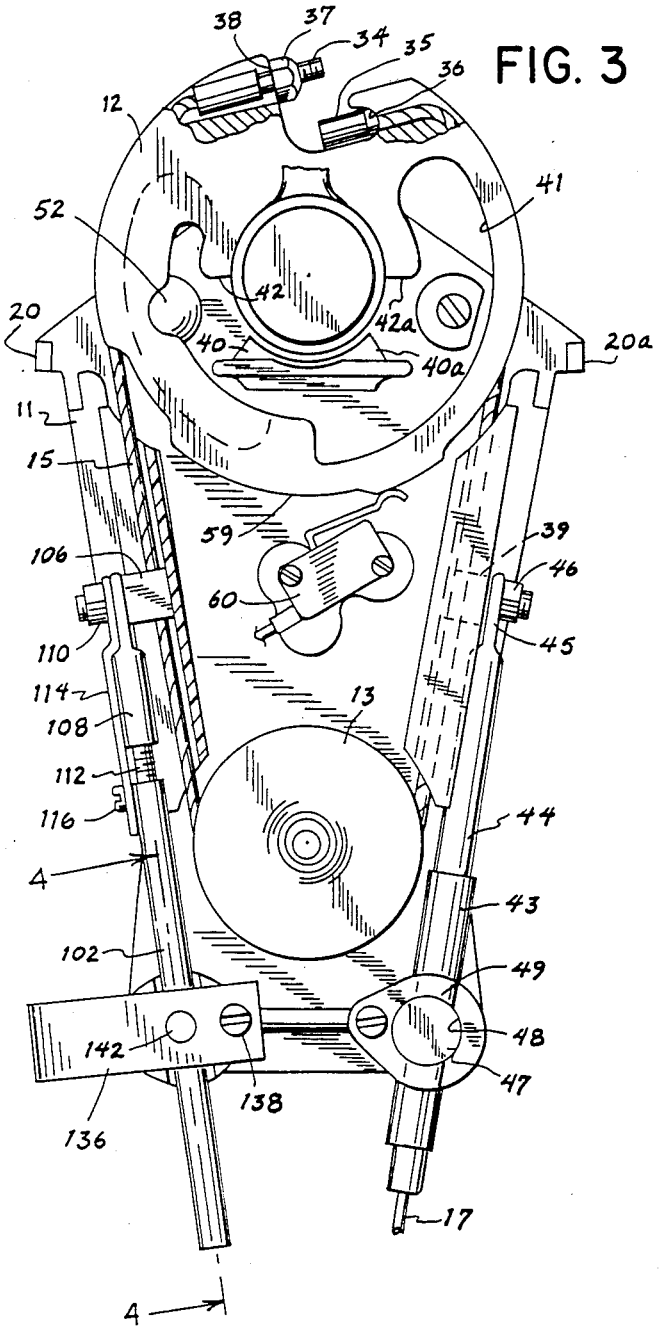
FIG. 3 is a side view of the assembly of FIG. 1 with portions removed.

There are two attachment points for cable 17. As viewed in FIG. 3, cable 17 is attached to the right hand straight run of pulley cable 15. Cable 17 may alternatively be attached to the left hand straight run of cable pulley 15, for example as in FIG. 3 of the above noted Karpathian et al patent. These two selective attachment points permit flexibility in the use of the assembly for push or pull applications as desired. Cable 17*a* likewise enjoys this two point attachment flexibility. In the present invention, the unused attachment point is employed to provide interlock and override features.

In the present invention, interlock structure is provided and prevents movement of shift lever 14 and its cable 17 when throttle lever 14*a* and its cable 17*a* are in a high speed position and with the operator applying normal force to shift lever 14. In a further feature of the invention, override structure is provided and permits movement of shift lever 14 and its cable 17 with throttle lever 14*a* in the high speed position when the operator applies an abnormally high force to shift lever 14, to enable high speed shifting including from forward to reverse to facilitate rapid deceleration.

A pair of link rods 102 and 104 are connected to respective pulley cables 15 and 15*a* along the left hand straight runs between pulleys 12 and 13, and 12*a* and 13*a*, respectively. Threaded stud block 106 is swaged to cable 15. Rigid bar 108 has a top flattened end with an aperture therethrough fitted on stud block 106 and retained by lock nut 110, comparably to threaded stud block 39 and lock nut 46. Bar 108 has a lower threaded male portion 112 received in an internally threaded upper female portion of link rod 102. Link rod 102 may be raised or lowered by threading it further onto or out of threaded portion 112, i.e toward or away from bar 108 and attachment block 106. Link rod 104 is comparable. This facilitates adjustment needed to set the maximum engine speed for shifting, and to synchronize detent notches, to be described, in the link rods with the shift positions in the transmission. A retainer plate 114 is also held on block 106 by nut 110 and includes a set screw 116 for locking link rod 102 to threaded portion 112 Extended slot 118, FIG. 1, in retainer plate 114 accommodates the up-down adjustment of link rod 102. The attachment of link rod 104 is comparable, and FIG. 1 shows its corresponding set screw 116*a*, retainer plate 114*a*, and lock nut 110*a*.

Figure 4:
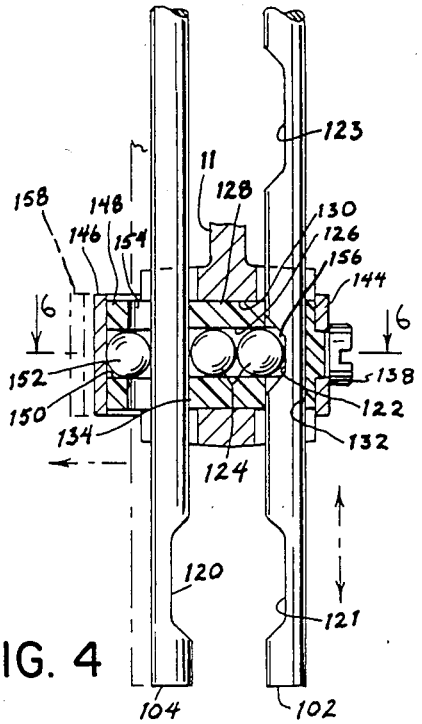
FIG. 4 is a sectional view taken alone line 4—4 of FIG. 3.

Link rod 104 is a throttle link rod member and has a detent configuration provided by notch 120 along its side, FIG. 4. Link rod 102 is a shift link rod member and has a detent configuration provided by notches 121, 122 and 123 along its side. A spherical ended shuttle pin or a pair of balls 124 is located in a central transverse passage 126 in a guide member 128 and coacts between the throttle and shift link rods 104 and 102 and their detent configurations to control the relative motion of the link rods and thus the two controls levers 14 and 14*a*.

Guide member 128 is mounted in bore 130 extending transversely through control body 11, which bore is the counterpart of bore 48. Guide member 128 has a pair of spaced parallel axial passages 132 and 134 therethrough for guiding respective link rods 102 and 104 to move axially therethrough, up-down as seen in FIG. 4, such that link rods 102 and 104 move parallel to each other and parallel to the straight run between pulleys 12 and 13. Shuttle passage 126 is transverse to axial guide passages 132 and 134.

Figure 6:
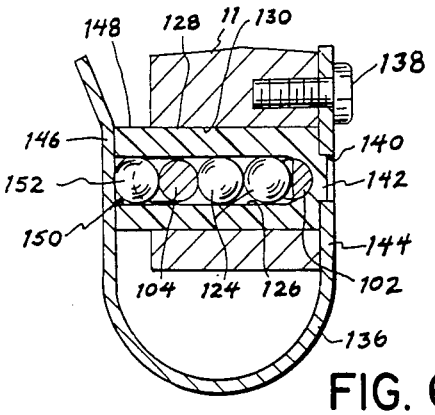
FIG. 6 is a sectional view taken along line 6—6 of FIG. 4.

Guide member 128 is mounted in bore 130 by a U-shaped spring 136, FIG. 6, mounted to control body 11 by screw 138. U-shaped spring 136 has an aperture 140 for receiving and locating boss 142 on guide member 128. U-shaped spring 136 bears inwardly against guide member 128 between the legs of the U. One leg 144 of the U bears against guide member 128 adjacent throttle link rod 102. The other leg 146 of the U bears against guide member 128 adjacent the throttle link rod 104. Leg 146 is spaced from link rod 104 by a portion 148 of guide member 128 having transverse passage 150 therethrough. A spacer member provided by ball 152 is in transverse passage 150. As viewed in FIGS. 4 and 6, ball 152 is engaged on its left side by leg 146 of the U-shaped spring, and is engaged on its right side by throttle link rod 104, such that link rod 104 is biased toward link rod 102 by U-shaped spring 136 acting through spacer member 152.

In the position shown in FIG. 4, shuttle balls 124 are in neutral notch 122 of shift link rod 102, and hence throttle link rod 104 may be moved freely up-down, i.e. engine speed may be increased or decreased by the operator by moving throttle lever 14*a*. Likewise, if shuttle balls 124 are in forward notch 121 or in reverse notch 123, then the throttle lever can likewise be moved to increase or decrease engine speed. Notch 120 in throttle rod 104 corresponds to an idle or low engine speed. In the position shown in FIG. 4, throttle link rod 104 is in a higher speed condition and shuttle balls 124 are not in notch 120. In this higher speed condition, shift link rod 102 cannot be moved under normal force applied to shift lever 14.

Figure 5:
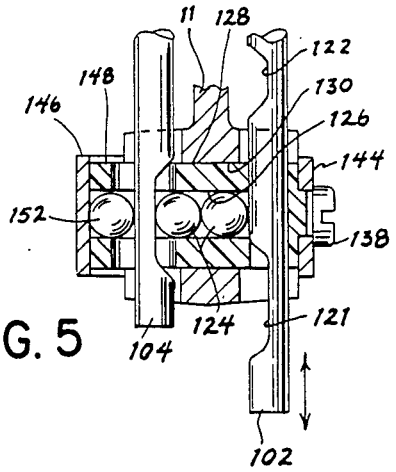
FIG. 5 is a view like FIG. 4, showing another operating position.

FIG. 5 shows throttle link rod 104 in the idle or low speed condition. In this position, shift link rod 102 may be freely moved up-down, whereby the transmission may be shifted between forward, neutral and reverse, with normal force applied to shift lever 14. In this manner, one link rod may move under normal force only when shuttle balls 124 are in a notch in the other link rod.

Figure 7:
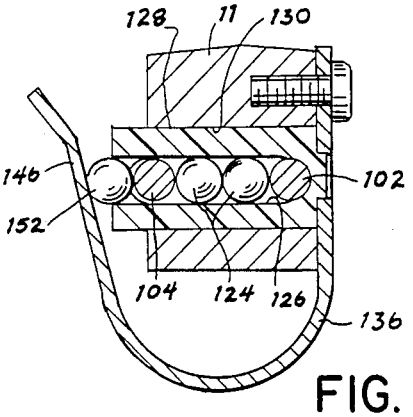
FIG. 7 is a view like FIG. 6, and shows an override condition.

U-shaped spring 136 provides an override means biasing the link rods 102 and 104 transversely towards each other and into engagement with shuttle balls 124 therebetween. Biasing spring 136 is overcome by an abnormally high force applied by the operator such that biasing spring 136 flexes outwardly and permits transverse relative movement of the link rods away from each other to disengage shuttle balls 124 from the detent notch configurations to permit the link rods to move axially through guide passages 132 and 134. Axial guide passage 134 has an extended transverse dimension as shown at 154, FIG. 4, wider than the diameter of throttle link rod 104 to permit transverse leftward movement of link rod 104 away from link rod 102. In the position shown in FIG. 4, if an abnormally high force is applied by the operator to shift lever 14, then shift link rod 102 at ramp 156 of notch 122 cams shuttle balls 124 leftwardly which in turn moves link rod 104 transversely leftwardly through extended width dimension 154 of axial guide passage 134, which in turn moves spacer ball 152 leftwardly and in turn flexes leg 146 of U-shaped spring 136 outwardly, as shown in dashed line at 158, and as shown in FIG. 7. The other ramps or cams of notches 121 and 123 likewise can move the shuttle balls 124 transversely and flex U-shaped spring 136, to permit emergency shifting even at high engine speed. The outward flexing of U-shaped spring 136 permits transverse movement of link rod 104 away from link rod 102, to permit link rod 102 to move axially through guide passage 132, and hence permit movement of shift lever 14.

It is recognized that various equivalents, alternatives and modifications are possible within the scope of the appended claims.

I claim:

1. A marine drive remote throttle and shift control comprising:

a dual lever actuator assembly for moving a pair of cables, one lever and its cable providing remote throttle control, the other lever and its cable providing remote shift control between forward, neutral and reverse;

interlock means normally preventing movement of the shift lever and its cable when the throttle lever and its cable are in a high speed position and with the operator applying normal force to said shift lever;

override means permitting movement of said shift lever and its cable with said throttle lever in said high speed position when the operator applies an abnormally high force to said shift lever, to enable emergency high speed shifting including from forward to reverse to facilitate rapid deceleration;

said interlock means comprising a pair of parallel link rods having facing notches, each rod coupled to a respective one of said cables;

guide means having a pair of axial passages, each guiding a respective one of said link rods for axial movement therethrough;

shuttle means in said guide means between said link rods for controlling the relative movement of said link rods and said levers, said shuttle means having a length extending transversely to said axial movement of said link rods, said length of said shuttle means being such that both said link rods cannot move freely at all times and such that one of said rods must be positioned so that said shuttle means is in one of said notches before the other rod can be moved freely, such that said other link rod coupled to said remote shift control cable cannot be moved from one shift position to another unless said notch in said one link rod coupled to said remote throttle control cable is transversely aligned with said shuttle means allowing said shuttle means to move transversely and make room for said other link rod to move, such that shifting is constrained to low engine speed or idle range as defined by the length of said notch in said one link rod;

said override means comprising biasing means normally holding said link rods in position such that said shuttle means is in one of said notches, said override means also comprising one of said axial passages having an extended transverse dimension to enable transverse movement of the respective said link rod therein in an override mode, said override mode being provided by said biasing means being overcome by an abnormally high force applied to said remote shift control lever such that said biasing means is flexed and permits transverse movement of said respective link rod through said extended transverse dimension of said one axial passage due to transverse movement of said shuttle means as the other respective link rod moves axially to a position with no notch aligned with said shuttle means, permitting movement of said remote shift control lever even through said shuttle means is not in any of said notches.

2. An actuator assembly for moving cores of push-pull cables relative to cable sheaths comprising:

a generally planar control body;

first and second shafts extending through the plane of said control body;

first and second control arm pulleys mounted for rotation on said first shaft on opposite sides of said control body and having operator controlled first and second levers operatively coupled with said first and second control arm pulleys, respectively;

first and second idler pulleys mounted for rotation on said second shaft on opposite sides of said control body;

first and second pulley cables carried on rims of said first and second pulleys, respectively, said first pulley cable having first and second opposite straight runs on the same side of said control body, said second pulley cable having first and second opposite straight runs on the same side of said control body opposite to said first pulley cable, each of said first straight runs of said pulley cables including attachment means for attaching an end of the core of a push-pull cable;

first and second link rods attached respectively to said first and second pulley cables along said second straight runs;

interlock means coacting between said first and second link rods and normally preventing movement of said first link rod, said first pulley cable, said first idler pulley and said first control arm pulley to a given position when said second link rod, said second pulley cable, said second idler pulley and said second control arm pulley are in a designated position and with the operator applying normal force to said first lever.

3. The actuator assembly according to claim 2 wherein said interlock means comprises guide means mounted to said control body and guiding said link rods to move parallel to each other and parallel to said second straight runs of said first and second pulley cables, said guide means having a pair of spaced guide passages therethrough receiving respectively said link rods, said guide means having a shuttle passage transverse to said guide passages and receiving shuttle means transversely movable between said link rods, said link rods having facing notches such that one link rod may move under normal force only when said shuttle means is in a notch in the other link rod.

4. The actuator assembly according to claim 3 comprising override means comprising biasing means biasing said link rods transversely towards each other in said guide means and into engagement with said shuttle means, said biasing means being overcome by abnormally high force applied to said one lever such that said biasing means flexes outwardly and permits transverse relative movement of said link rods away from each other to disengage said shuttle means from said detent configuration to permit said link rods to move axially through said guide passages parallel to said second straight runs of said first and second pulley cables.

5. The actuator assembly according to claim 4 wherein said guide passage receiving said other link rod has an extended transverse dimension wider than the diameter of said other link to permit transverse movement of said other link rod away from said one link rod.

6. The actuator assembly according to claim 5 wherein said biasing means comprises a U-shaped spring having a pair of legs bearing inwardly against said guide means, one said leg of said U-shaped spring bearing against said guide means adjacent said one link rod, the other said leg of said U-shaped spring bearing against said guide means adjacent said other link rod and spaced from said other link rod by a portion of said guide means having a second transverse passage therethrough, and comprising spacer means in said second transverse passage engaged on one side by said other leg of said U-shaped spring and engaged on the other sdie by said other link rod, such that said other link rod is biased toward said one link rod by said U-shaped spring acting through said spacer means.

7. An add-on adapter kit for a marine drive remote throttle and shift control having a dual lever actuator assembly for moving cores of push-pull cables relative to cable sheaths and having a generally planar control body, first and second shafts extending through the plane of said control body, first and second control arm pulleys mounted for rotation on said first shaft on opposite sides of said control body and having throttle and shift levers respectively operatively coupled thereto, first and second idler pulleys mounted for rotation on said second shaft on opposite sides of said control body, first and second pulley cables carried on rims of said first and second pulleys, respectively, said first pulley cable having first and second straight runs on the same side of said control body, said second pulley cable having first and second straight runs on the same side of said control body and opposite to said first pulley cable, each of said pulley cables including attachment means for attaching an end of the core of a push-pull cable to said first straight run, support means to hold said ends of said cores parallel to said first straight runs of said pulley cables, said add-on adapter kit comprising:

first and second link rods attached respectively to said second straight runs of said first and second pulley cables;

interlock means coacting between said first and second link rods and normally preventing movement of said first link rod, said first pulley cable, said first idler pulley and said first control arm pulley to a given position when said second link rod, said second pulley cable, said second idler pulley and said second control arm pulley are in a designated position and with the operator applying normal force to said first lever.

8. The add-on adapter kit according to claim 7 wherein said interlock means comprises guide means mounted to said control body and guiding said link rods to move parallel to each other and parallel to said second straight runs of said pulley cables, said guide means having first and second spaced guide passages extending axially therethrough parallel to said second straight runs of said pulley cables and receiving said link rods, said guide means having a shuttle passage transverse to said guide passages and receiving shuttle means transversely movable between said link rods, said link rods having facing notches such that one link rod may move under normal force only when said shuttle means is in a notch in the other link rod.

9. The add-on adapter kit according to claim 8 further comprising override means comprising biasing means biasing said link rods transversely towards each other in said guide means and into engagement with said shuttle means, said biasing means being overcome by abnormally high force applied by the operator to said shift lever such that said biasing means flexes outwardly and permits transverse relative movement of said link rods away from each other to permit said link rods to move axially through said guide passages parallel to said second straight runs of said pulley cables.

10. The add-on adapter kit according to claim 9 wherein said guide passage receiving said other link rod has an extended transverse dimension wider than the diameter of said other link rod to permit transverse movement of said other link rod away from said one link rod.

11. The add-on adapter kit according to claim 10 wherein said biasing means comprises a U-shaped spring having a pair of legs bearing inwardly against said guide means, one said leg of said U-shaped spring bearing against said guide means adjacent said one link rod, the other said leg of said U-shaped spring bearing against said guide means adjacent said other link rod and spaced from said other link rod by a portion of said guide means having a second transverse passage therethrough, and wherein said add-on adapter kit further comprises spacer means in said second transverse passage engaged on one side by said other leg of said U-shaped spring and engaged on the other side by said other link rod, such that said other link rod is biased toward said one link rod by said U-shaped spring acting through said spacer means.

* * * * *